US006095256A

United States Patent [19]

Lindsay

[11] Patent Number: 6,095,256

[45] Date of Patent: Aug. 1, 2000

[54] HAND-HELD PNEUMATIC IMPACT TOOL AND METHOD OF CONTROLLING THE SAME

[76] Inventor: Steven James Lindsay, 3714 W. Cedar Hills Dr., Kearney, Nebr. 68845

[21] Appl. No.: 09/487,123

[22] Filed: Jan. 19, 2000

[51] Int. Cl.[7] ..... B25D 9/14

[52] U.S. Cl. ..... 173/115; 173/122; 173/132; 173/200

[58] Field of Search ..... 173/115, 128, 173/200, 132, 121, 202, 203, 120

[56] References Cited

U.S. PATENT DOCUMENTS 3,111,997 11/1963 Kremel, Jr. ..... 173/132
3,393,755 7/1968 Glaser et al. .
3,747,692 7/1973 Davidson ..... 173/122
4,694,912 9/1987 Glaser .
4,903,784 2/1990 Glaser ..... 173/200
5,203,417 4/1993 Glaser .
5,515,930 5/1996 Glaser .

*Primary Examiner*—Scott A. Smith

[57] ABSTRACT

A hand-held pneumatic impact tool and method of controlling the same for use in fine hand working operations includes a handpiece, a foot-operated flow control valve and a hand operated flow control needle valve. The handpiece includes a housing having a cavity and annular shoulder accommodating a stepped piston dividing the cavity into three chambers. The design provides a means to oscillate a piston without delivering impacts and to oscillate the piston with varying amounts of impact energy.

22 Claims, 5 Drawing Sheets

HAND-HELD PNEUMATIC IMPACT TOOL AND METHOD OF CONTROLLING THE SAME

CROSS-REFERENCE TO RELATED APPLICATIONS

Not applicable.

STATEMENT REGARDING FED SPONSORED R & D

Not applicable.

REFERENCE TO MICROFICHE APPENDIX

Not applicable.

BACKGROUND OF THE INVENTION

1. Field of Invention

This invention relates to a hand-held pneumatic power tool to be used for delicate hand engraving and stone setting in the hand engraving and jewelry field.

2. Description of Prior Art

Traditionally the tool used (and for a large part still used) for hand engraving and stone setting is a palm push graver tool. This traditional hand engraving tool consisted of the working point or graver set into a wood handle that fit comfortably into the palm of the hand. I have been a full time hand engraver for twenty years and find this traditional palm push graver is the most comfortable. A problem that arises with this traditional tool is that as the graver point is pushed through a cut, even in very fine engraving cuts, there is a small loss of control due to the force that is exerted. The outcome of this loss of control can be the graver point exiting out of the cut and the exerted force on the tool will cause slippage across the work. For heavier engraving cuts, engravers and stone setters have used a small hand-held hammer to strike against the graver to drive it through a cut. This has helped with some of the problem described above, as it is unnecessary to exert a great deal of force when the hammer does the work. A disadvantage with this hand-held hammer method is it leaves the engraving cuts jagged with small flats caused by each hammer impact.

In recent times impact power tools have been developed to attempt to aid the jeweler and engraver. For example, U.S. Pat. No. 4,694,912 (1987) and U.S. Pat. No. 5,203,417 (1993) both to Glaser, use compressed air through a rotary valve to generate pulses of air. This is used to move a piston in the hand-held device forward, depressing a spring and at the same time impacting the graver holder. This design has an adverse effect of loss of power or no power at all when the piston floats, caused when the pulses of air do not give the return spring time to return the piston. This is caused by the frequency of the air pulses being too close together and/or by too much air pressure in each pulse. Moreover, previous hand-held engraving impact tools such as U.S. Pat. No. 3,393,755 to Glaser and Rohner (1968) have required a separate, specialized source of vacuum air pulses to the hand-held device. In the case of U.S. Pat. No. 4,694,912 to Glaser (1987) described above, a specialized rotary valve is required as a means of power to rotate the valve to provide a source of air pulses to the hand-held impact device.

A more recent patent U.S. Pat. No. 5,515,930 to Glaser (1996) discloses a hand-held pneumatic apparatus. This hand-held impact tool also uses a spring, similar to the impact tools described above, for the return stroke of the piston. This spring has an unfavorable effect to the range of impacts that can be achieved with the device, as enough air pressure must be used to compress the spring sufficiently to enable the piston to come into contact with the graver holder or anvil. A spring that is very light in strength can be used and finer impacts will be achieved, but this results in insufficient high impact power when the user desires greater impact energy. On the other hand, if a stronger spring is used, air pressure will need to be increased to supply enough force to depress the heavier spring and this additional pressure will cause the piston to travel with more velocity and consequently the user discovers that the tool cannot achieve fine low power impacts, but only high power impacts. It should be noted that this described strength of spring and range of impacts problem also exists with impact tool disclosed in U.S. Pat. No. 4,694,912 to Glaser (1987). Returning to U.S. Pat. No. 5,515,930 to Glaser (1996), this device also requires a special pressuresensing element within the foot valve to start the piston oscillating by giving a quick surge of higher air pressure. This is needed as the tool's housing and tip will vibrate excessively if the tool housing or tool tip is not held against a fixed work surface while the device is oscillating and therefore requires the tool to start after the tool tip is placed against the work with the surge of higher air pressure. This vibration on an operator's hand can quickly fatigue the hand and can also make it difficult and impractical to place the tool tip where desired to begin an engraving cut. In addition, the vibration can dull the tool tip or ruin the work if the user attempts to place the tool tip to the work while the device is oscillating. This tool therefore requires its tip to be set into the work before starting the oscillation and therefore requires the special sensing element to help it start with a surge of air pressure. The air pressure surge to start the oscillation can also cause a surge of harder impacts than desired, making fine engraving work impractical.

BRIEF SUMMARY OF THE INVENTION

In accordance with the present invention a hand-held pneumatic impact tool comprises a handpiece, a foot-operated flow control valve and a hand operated flow control needle valve. The handpiece includes a housing having a cavity and annular shoulder accommodating a stepped piston dividing the cavity into three chambers.

Objects and Advantages

Accordingly, several objects and advantages of my invention are:

(a) to provide a hand-held pneumatic impact tool similar in size and shape to the traditional palm push engraving tool;

(b) to provide a hand-held pneumatic impact tool with superb control of very fine impacts for use in ultra fine hand engraving;

(c) to provide a hand-held pneumatic impact tool that has a wide range of power and that will not lose oscillating timing throughout a wide range of air pressures;

(d) to provide a hand-held pneumatic impact tool that is not dependant on a spring for the piston's return or impact stroke;

(e) to provide a hand-held pneumatic impact tool that will begin oscillation without requiring a surge of air pressure over the normal operating idling ready-state air pressure;

(f) to provide a hand-held pneumatic impact tool in which the idling ready-state can be controlled by the user's preference and needs;

(g) to provide a hand-held pneumatic impact tool that does not vibrate excessively allowing the user to set and place the tool tip into the work with confidence;

(h) to provide a hand-held pneumatic impact tool which allows the operator to adjust the position of the air line attachment to the impact tool to his or her comfort;

(i) to provide an adjustment within the hand-held pneumatic impact tool itself for the user to adjust the length and speed of the piston's stroke to his or her preference according to the type of engraving work that is being executed.

Further objects and advantages are to provide a hand-held pneumatic engraving tool in which the piston, once started oscillating with constant fine flow of air pressure will not stop unexpectedly between hand engraving operations, but return to a fine oscillating idle. Still further objects and advantages of the invention will become apparent from a consideration of the drawing and ensuing description.

BRIEF DESCRIPTION OF THE DRAWINGS

Embodiments of the present invention are described below with reference to attached drawing figures, wherein.

DETAILED DESCRIPTION OF THE INVENTION

FIGS. 1–5 and FIGS. 17–19

Figure 1:
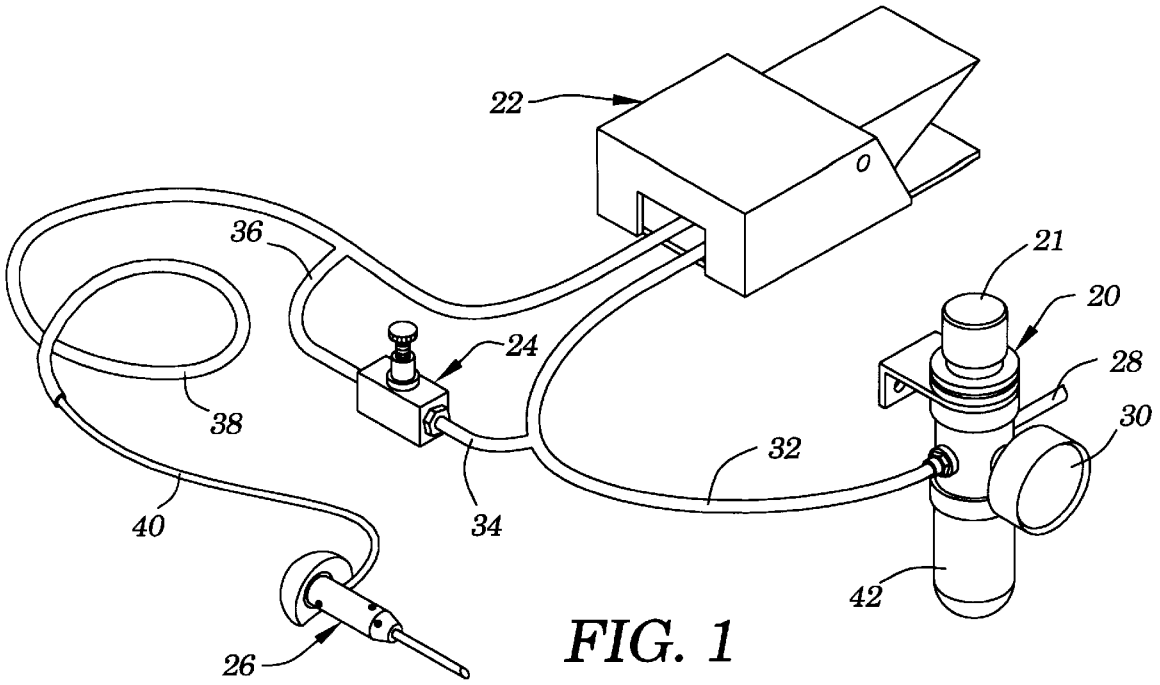
FIG. 1 is a perspective view of the hand-held pneumatic impact tool apparatus in accordance with the present invention.

A hand-held pneumatic impact tool and method of controlling the same in accordance with the present invention is illustrated in FIG. 1. The apparatus includes an air supply line 28, a hand operated pressure regulator assembly 20, a foot-operated flow control valve assembly 22, a distribution line 32 extending between the hand operated pressure regulator assembly 20 and the foot-operated flow control valve assembly 22, an impact handpiece 26, a delivery line 38 and reduced diameter delivery line 40 extending between the foot-operated flow control valve assembly and the handpiece, and a hand-operated flow control needle valve 24 spliced between the distribution line 32 and delivery line 38 via lines 34 and 36.

The air supply line 28 connects the pressure regulator assembly 20 to a source of pressurized air, such as a conventional air compressor. The pressure regulator assembly 20 includes an inlet connected to the supply line 28, an outlet connected to the distribution line 32, and a valve for regulating airfow between the inlet and the outlet. In addition, the pressure regulator assembly 20 includes a pressure-sensing element for sensing the pressure of the air distributed from the regulator and for controlling the regulator to limit the pressure of the distributed air. A hand-operated knob 21 is connected to the pressure regulator assembly 20 for adjusting the regulated pressure distributed by the regulator. A gauge 30 is provided on the regulator to monitor the pressure being distributed. An additional element of the pressure regulator assembly is an air-cleaning filter 42 to filter the air that passes through the regulator.

Figure 17:
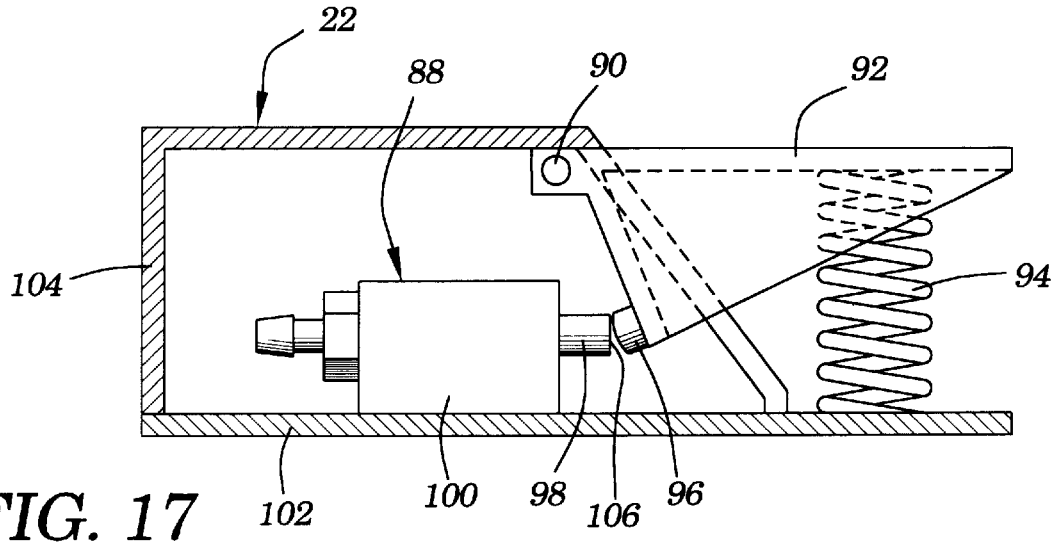
FIG. 17 is a side sectional view of a foot-operated flow control valve assembly in accordance with the present invention.
Figure 18:
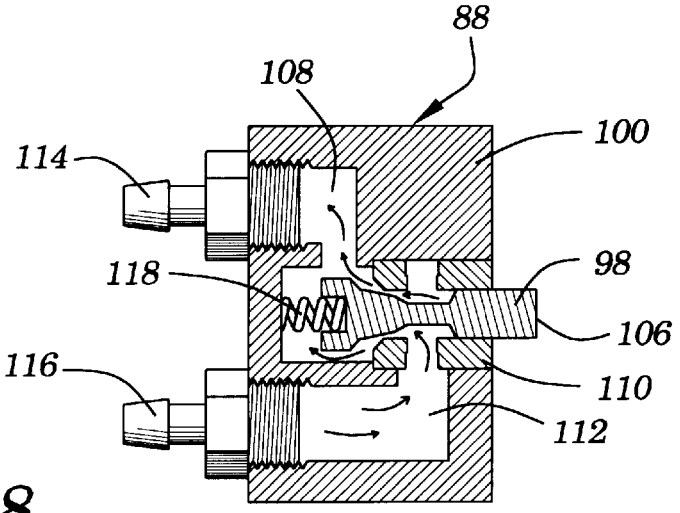
FIG. 18 is a top sectional view of an air flow valve contained in the foot-operated flow control valve assembly illustrated in FIG. 17.

The foot-operated flow control valve assembly 22 is illustrated in a sectional view in FIG. 17. A flow control valve 88 is firmly attached to a base 102. A foot pedal 92 is attached to a housing 104 by a pivot pin 90 permitting the foot pedal to pivot when the user depresses the pedal with his or her foot. A compression spring 94 is place between the base 102 and underside of the foot pedal to return the foot pedal to the original position when the user takes his or her foot off. Referring to the top sectional view of the flow control valve 88 in FIG. 18, a plunger holder 110 has a secured, airtight fit into a valve housing 100. A plunger 98 has a tapered shape within the two ends of the plunger. Depending on the position of plunger 98, two chambers 112 and 108 within a housing 100 can become in communication with each other. When the foot pedal is not depressed, a spring 118 will push the plunger out until the taper on the plunger mates with the taper in plunger holder 110 closing off communication and air flow between chambers 112 and 108. In FIG. 17 a protrusion 96 is firmly attached to the foot pedal 92. When the foot pedal is depressed, the protrusion 96 will press against plunger face 106 pushing the plunger into the flow control valve 88 and as a result push the plunger away from the mating taper within the plunger holder opening a communication passageway between chambers 112 and 108, illustrated in FIG. 18. The further the user depresses the foot pedal, the larger the opening between the mating taper surfaces of the plunger and the plunger holder become, permitting more air to flow between chambers 112 and 108. Referring to FIG. 1 and FIG. 18 chamber 112 is connected and is in communication with the distribution line 32 (FIG. 1) with a screw-in barb connector 116. Chamber 108 is connected and is in communication with the delivery line 38 (FIG. 1) with a screw-in barb connector 114.

Figure 19:
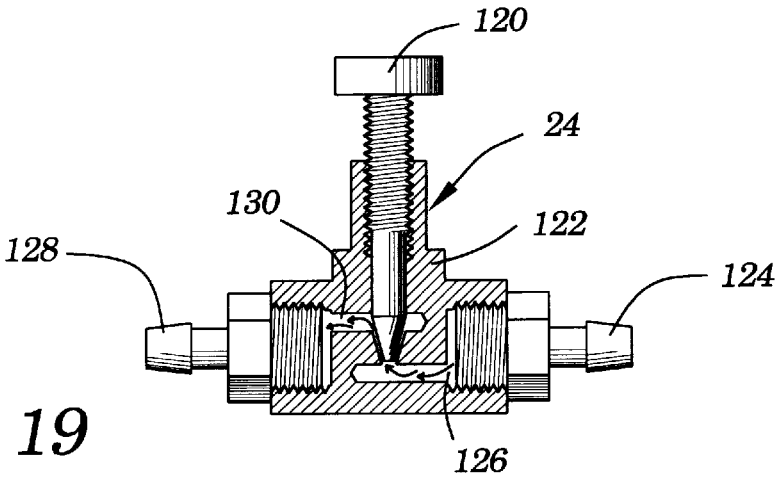
FIG. 19 is a sectional view of a needle valve in accordance with the present invention.

Referring to the hand-operated flow control needle valve assembly 24 illustrated in FIG. 19, an adjusting screw 120 has a taper on the end that when threaded all the way into housing 122 will fit against a mating taper in housing 122. This tapered hole within housing 122 intersects a portion of each of chamber 126 and chamber 130. When this adjusting screw is threaded all the way into housing 122 it will block communication and air flow between chambers 126 and 130. When the adjusting screw 120 is threaded out it will open communication between the chambers permitting air flow. The more the adjusting screw is threaded out the more the air flow between the chambers. Referring to FIG. 1 and FIG. 19, chamber 126 is in communication with line 34, which is spliced into and in communication with the distribution line 32. Chamber 130 is in communication with line 36, which is spliced into and in communication with the delivery line 38. Both of the chambers 126 and 130 have screw-in barb connectors 124 and 128 for attaching the lines 34 and 36.

Figure 2:
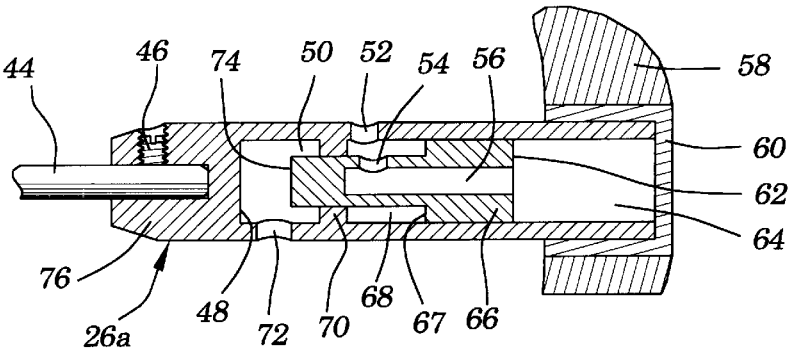
FIG. 2 is a sectional view of a hand-held pneumatic impact tool constructed in accordance with the present invention.
Figure 3:
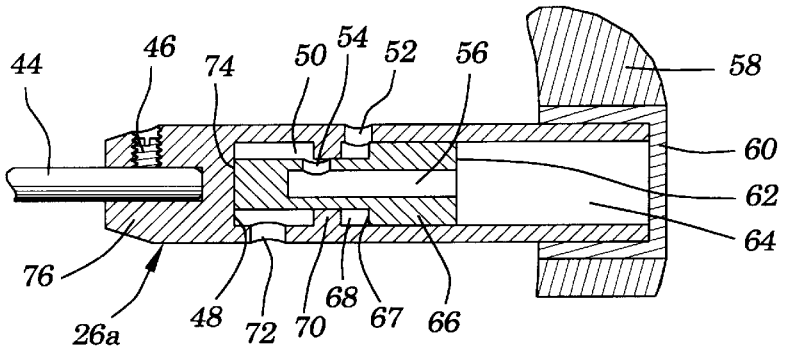
FIG. 3 is the same view as FIG. 2, differing in that the piston is occupying the extreme forward position.

An impact handpiece 26*a*, is illustrated in FIG. 2 and includes a cylindrical housing 76 with a cavity and an annular shoulder 70 accommodating a two-step piston 66 that can move axially within the housing cavity and dividing the cavity into the following three chambers:

- a head chamber 50 defined by the front piston face 74, the cavity bottom face 48, the walls of the housing, and one side of the annular shoulder 70. This head chamber constantly communicates with the atmosphere through the housing exhaust port 72;
- a central chamber 68 defined by the piston step end face 67, the external diameter of the smaller step of the piston, the walls of the housing, and one side of the annular shoulder 70. In addition the annular shoulder 70 separates this central chamber from the head chamber. This central chamber constantly communicates with the compressed air source through housing intake port 52;
- a rear chamber 64 defined by the rear piston face 62, an end cap 60, and the walls of the housing. Depending on the position of the piston relative to the housing, this rear chamber periodically communicates with a compressed air source through passage 56, piston port 54, and housing intake port 52, or with the atmosphere through passage 56, piston port 54, and housing exhaust port 72.

Tool tip 44 is held in the handpiece housing 76 by tightening setscrew 46. A handle 58 is comfortably shaped to fit into the palm of the hand and to provide bottom clearance as the tool is used over the work. The handle 58 is fixed onto the end cap 60. The end cap 60 in turn fits onto the housing 76 with an airtight seal. It should be noted that it is not shown in the illustrations, but a gasket, O-ring, or equivalent can be used between the housing 76 and end cap 60 to help provide an airtight seal together with a setscrew to hold the end cap on the housing.

Operation—FIGS. 1–5

The hand-held impact tool operates as follows. Referring to FIG. 2, when compressed air is introduced to the housing intake port 52 and piston 66 is in a position illustrated in FIG. 2, compressed air will fill the central chamber 68 and also the rear chamber 64 via piston port 54 and passage 56. The air pressure in the central chamber will attempt to push the piston further to the rear of the tool by pressing against the piston step end face 67, but the air pressure in the rear chamber 64 will attempt to push the piston in the opposite direction toward the front of the cavity by pressing against the rear piston face 62. Because the surface area of the rear piston face 62 is greater than the surface area of piston step end face 67, the piston will shift toward the front of the cavity until the front piston face 74 collides with the end of the cavity bottom face 48, thus delivering an impact. While the piston was traveling toward the cavity bottom face, piston port 54 for a short time was aligned with annular shoulder 70 and the compressed air from the central chamber was the shut off to piston port 54 and thus to the rear chamber 64. With continuing movement of the piston toward the cavity bottom face 48 piston, port 54 became in communication with head chamber 50 permitting the air pressure that was built up in the rear chamber 64 to be released into the atmosphere through passage 56 in the piston, to the head chamber 50, and finally out housing exhaust port 72. With the piston in this front most position illustrated in FIG. 3 and the air pressure released out of the rear chamber, the air pressure in the central chamber will press against the piston step end face 67 and together with an impacting recoil shift the piston back to the rearward position illustrated in FIG. 2. With the piston in this rearward position, piston port 54 is now in communication with central chamber 68 and air pressure from housing intake port 52. The air pressure will now again build in rear chamber 64 through passage 56 and the process is repeated, thus oscillating the piston.

Figure 4:
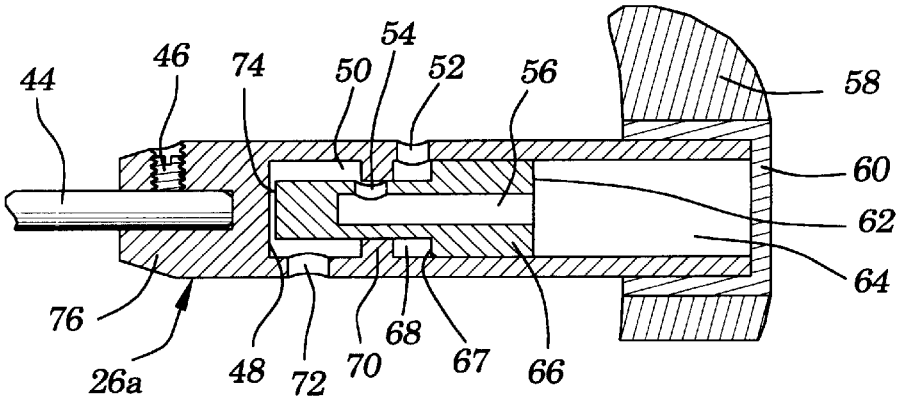
FIG. 4 is the same view as FIG. 3, differing in that the piston is occupying not quite the extreme forward position.
Figure 5:
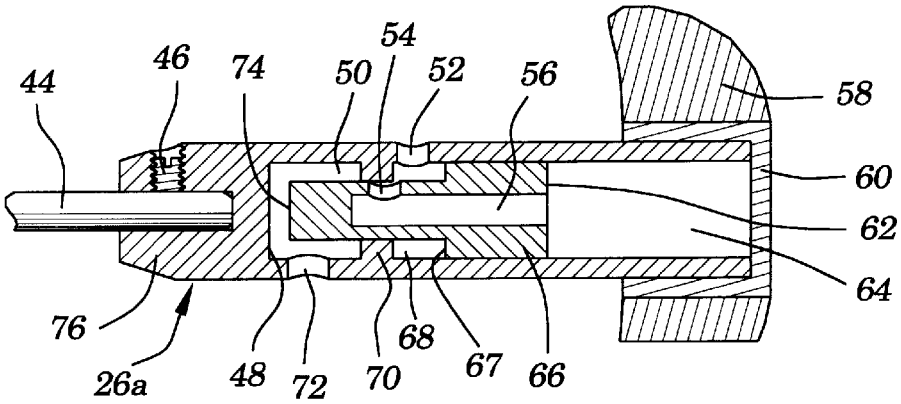
FIG. 5 is the same view as FIG. 4, differing in that the piston is occupying a slight rearward position.

Illustrations FIG. 4 and FIG. 5 depict the idling ready-state of the impact handpiece. This idling state is similar to what is described above except the piston oscillates with a very short movement stroke and without the front piston face 74 colliding or impacting with the cavity bottom face 48. This idling state can be achieved with very short movement strokes because piston port 54 is the same width as the annular shoulder 70. With this configuration the piston port 54 can move just a few thousandths of an inch to either side from alignment with the annular shoulder 70 for receiving and exhausting sufficient air pressure to oscillate the piston. The air pressure and air flow required for this idling oscillation are very low. FIG. 4 depicts the idling state with the piston shifted to the front position and the piston port 54 in communication with head chamber 50. FIG. 5 illustrates the idling state with the piston shifted to the rear position and piston port 54 in communication with central chamber 68.

Referring to FIG. 1, the hand operated pressure regulator assembly 20, the foot-operated flow control valve assembly 22, and the hand operated flow control needle valve 24 operate together supplying the needed airflow to the handpiece as follows. With an air compressor or the like supplying air pressure through the supply line 28, the hand-operated pressure regulator 20 is adjusted to the desired pressure by turning knob 21 and viewing pressure gauge 30. The hand-operated flow control needle valve 24 is adjusted to permit a fine flow of air between the distribution line 32 and delivery line 38 and the reduced diameter delivery line 40 and finally to the handpiece 26. This will permit the piston to begin oscillating in the idling state. The hand-operated flow control needle valve 24 is adjusted so that the idling is faint with slight piston oscillation. The idling impact handpiece is now ready for impact operation. The user places the idling impact tool's graver or tool tip onto the work and slowly depresses the foot pedal of the foot-operated flow control valve assembly 22. The piston in the handpiece will begin delivering light impacts. As the user continues to depress the foot pedal, thus increasing air pressure to the handpiece, the piston will deliver harder and harder impacts. When the user has finished an engraving or stone setting operation he or she lets up on the foot pedal and the impact tool will return to the idling oscillation ready-state.

Figure 6:
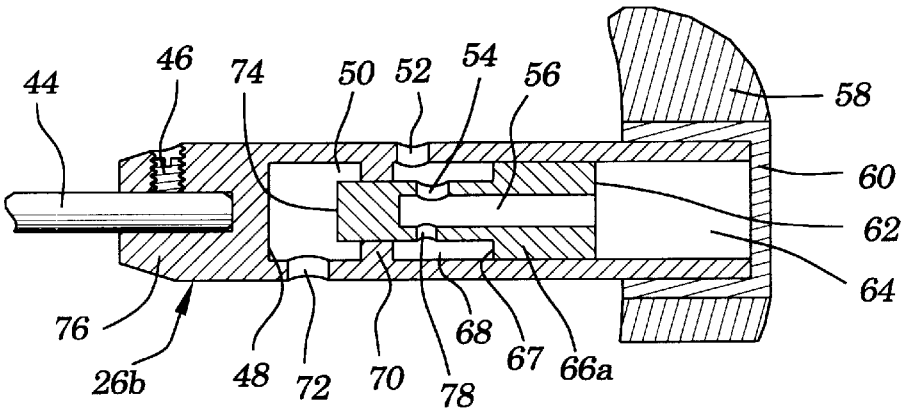
FIG. 6 illustrates a hand-held pneumatic impact tool in accordance with the present invention, in which the piston has an additional port hole.

FIG. 6—Second Embodiment

Referring to FIG. 6, a second embodiment of the impact handpiece, 26b, is depicted. Impact handpiece 26*b* is similar to handpiece 26*a* (illustrated in FIG. 2, FIG. 3, FIG. 4, and FIG. 5) in all but one respect. Handpiece 26*b* has a piston port 54 similar to handpiece 26*a* but handpiece 26*b* has an additional small piston port 78. This small piston port 78 hole is placed so that the front most edge of the hole is aligned perpendicular to the front most edge of the piston port 54 hole. The small port aligned in this manner will aid in releasing more compressed air out of rear chamber 64 in less time when the piston is in its front most position (i.e. making an impact). This release will begin when the piston and front edges of piston port 54 and small piston port 78 become in communication with the head chamber 50. Lowering as much pressure as possible in the rear chamber 64 with the piston in this position allows the piston to travel further back in the return stroke. Longer return strokes are helpful in delivering harder impacts strokes since the piston has more time to accelerate to a greater velocity during the impact stroke. When this additional small piston port 78 communicates with the central chamber 68 it will also be used together with piston port 54 to fill rear chamber 64 faster which will shorten some of the return stroke, but in doing so places more air pressure into the rear chamber 64 increasing the power of the impact stroke. These port holes are positioned in such a manner that during a return stroke, piston port 54 will become in communication with central chamber 68 before small piston port 78, helping give a slightly longer return stroke than if the port holes were the same width and position. It is not illustrated in FIG. 6, but more than one small piston port 78 may be included around the smaller piston step diameter in the same location illustrated for small piston port 78 with an overall benefit in power to the impact stroke.

Figure 7:
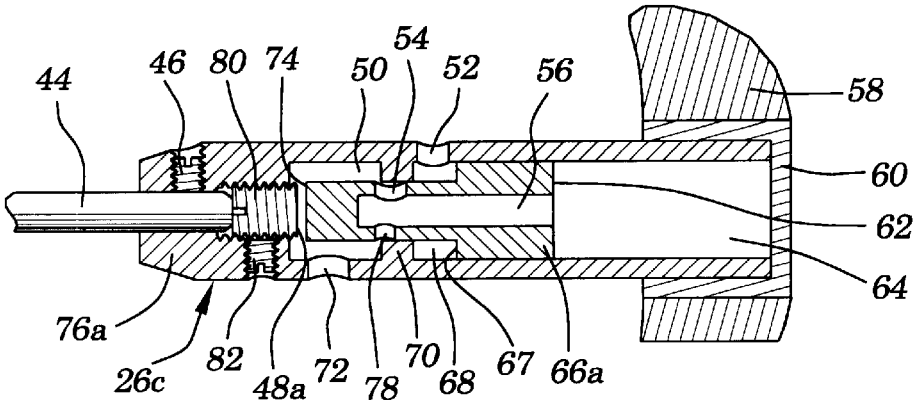
FIG. 7 illustrates a hand-held pneumatic impact tool in accordance with the present invention, in which the housing has an adjusting means for the speed and length of piston stroke.

FIG. 7—Third Embodiment

Referring to FIG. 7, a third embodiment of the impact handpiece, 26*c*, is depicted. Impact handpiece 26*c* is similar in all respects to handpiece 26*b* (illustrated in FIG. 6) except that handpiece 26*c* has an addition of two setscrews 80 and 82. Setscrew 80 has been included to the bottom of the cavity so that cavity bottom face 48*a* may be adjustable axially within the handpiece. Setscrew 82 has been included perpendicular to and in intersection with setscrew 80. Setscrew 82 is used to lock setscrew 80 in place once the user has setscrew 80 positioned to his or her preference. The user gains access to setscrew 82 by first removing tool tip 44 by loosing setscrew 46. The user may adjust setscrew 80 while the handpiece is oscillating. By adjusting setscrew 80, and thus cavity bottom face 48*a*, it is possible to adjust the speed that the impacts occur and the length of the return strokes, which will affect the overall impact power range of the handpiece. Adjusting setscrew 80, and thus cavity bottom face 48*a*, towards the front tool tip end of the handpiece and having piston 66*a* in its front most position (i.e. making an impact), piston port 54 and small piston port 78 openings will be positioned further into head chamber 50 creating a larger passage for air pressure in the rear chamber 64 to escape into the atmosphere. Lowering as much pressure as possible in the rear chamber 64 with the piston in this position allows the piston to travel further back in the return stroke. Longer return strokes are helpful in delivering harder impact strokes since the piston has more time to accelerate to a greater velocity during the impact stroke. In addition these longer impact strokes take more time to cycle, thus the strokes per minute slow down when adjusting setscrew 80 in the direction just described. When setscrew 80 is adjusted in the opposite direction than just described so that cavity bottom face 48*a* is moved away from the tool tip end of the handpiece and so that it protrudes further into the head chamber 50 and having piston 66*a* in its front most position (i.e. making an impact), piston port 54 and small piston port 78 openings will now be positioned not as far into head chamber 50, creating a smaller passage for air pressure in the rear chamber 64 to escape into the atmosphere. Since not as much air pressure can escape from rear chamber 64, the return stroke of the piston will not return as far into rear chamber 64. This effect will give the tool shorter and less hard impacts over all air pressure ranges and the piston will in addition oscillate faster when impacting. Being able to adjust the cavity bottom face 48*a* and thus the overall impact power range and impact speed helps make the impact handpiece versatile for each user's preference and work requirements.

Figure 8:
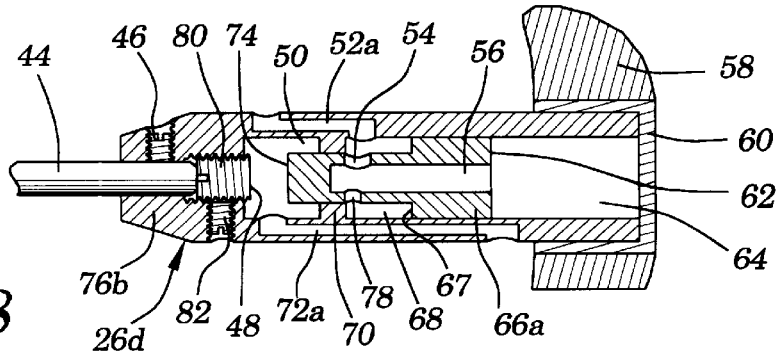
FIG. 8 illustrates a hand-held pneumatic impact tool in accordance with the present invention, in which the housing has in and out port passage ways leading to more convenient areas on the outside surface of the tool.

FIG. 8—Fourth Embodiment

Referring to FIG. 8, a fourth embodiment of the impact handpiece, 26*d*, is depicted. Impact handpiece 26*d* is similar in respect to handpiece 26*c* (illustrated in FIG. 7) except the housing walls of housing 76*b* have been thickened so that there is room for housing intake port 52*a* and the housing exhaust port 72*a* to run parallel within the housing walls and out to a more user friendly location on the outside surface of the housing. Housing intake port 52*a* in FIG. 8 is illustrated coming out in a more forward position on the housing. This position is a more convenient one for delivery line 40 (FIG. 1) to be inserted than where it inserts on handpiece 26*a*, 26*b*, or 26*c*. As the user holds handpiece 26*d* in his or her hand, delivery line 40 is inserted in this more forward position on the handpiece so that the delivery line will ride next to the web of the hand between the thumb and index finger and may then be laid over the back of the hand, out of the way. In FIG. 8 housing exhaust port 72*a* is depicted coming to a more rearward location on the outside surface of housing 76*b*. In this position, next to handle 58, it is in a more out of the way position and it is less likely for the user to inadvertently cover or plug this exhaust port hole with his or her hand.

FIGS. 9–13—Fifth and Preferred Embodiment

Figure 9:
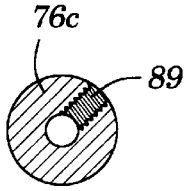
FIG. 9 is a sectional view taken along 9—9 of FIG. 10.
Figure 10:
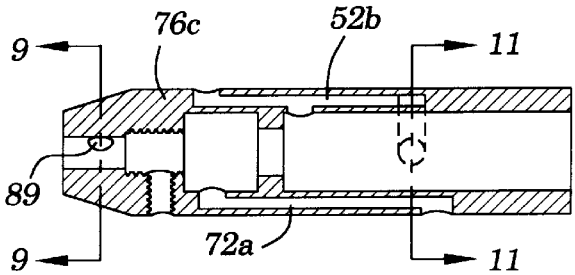
FIG. 10 is a sectional view of a housing of a hand-held pneumatic impact tool in accordance with the present invention, in which more than one entrance is presented to the intake port and the holding setscrew for the tool tip is rotated to a more convenient position.
Figure 11:
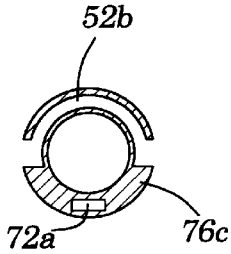
FIG. 11 is a sectional view taken along 11—11 of FIG. 10.
Figure 12:
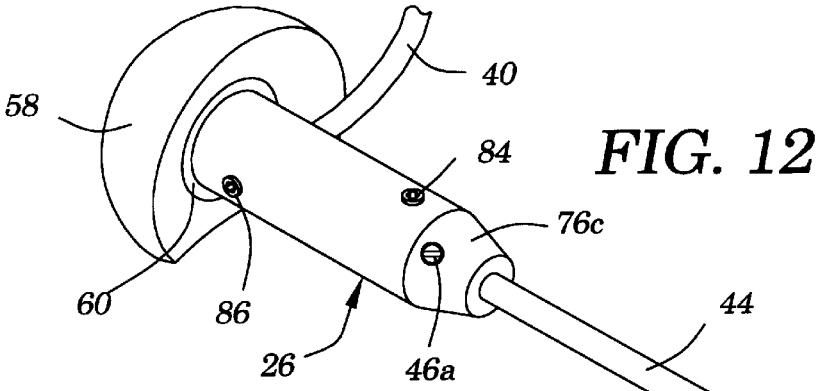
FIG. 12 is an elevated, isometric view of the housing in FIG. 10 illustrated together with the other elements of a hand-held pneumatic impact tool in accordance with the present invention.
Figure 13:
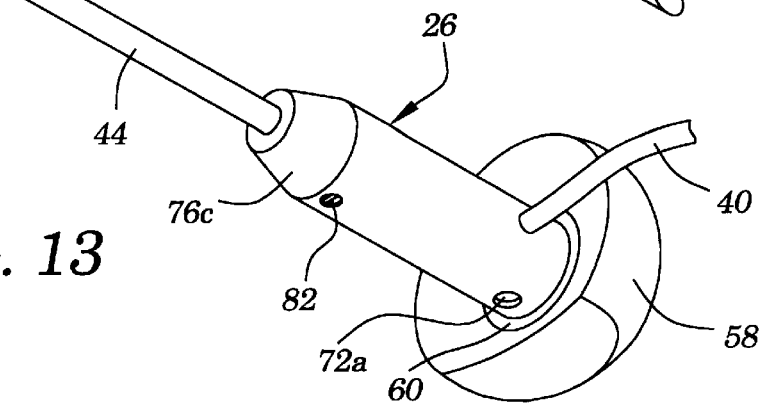
FIG. 13 is a lowered, isometric view of the same hand-held pneumatic impact tool in accordance with the present invention as illustrated in FIG. 12.

In FIG. 9, FIG. 10, FIG. 11, FIG. 12, and FIG. 13 is illustrated a fifth and preferred embodiment. FIG. 9, FIG. 10, and FIG. 11 depict only the housing 76*c* element of this embodiment. All other elements except this illustrated housing 76*c* are identical to handpiece 26d in FIG. 8. A threaded hole 89 for the tool tip holding setscrew 46 (illustrated in FIG. 8) has been rotated 45 degrees in FIG. 10. FIG. 9 is a sectional view taken along 9—9 of FIG. 10 and illustrates the rotation of the threaded hole 89. This location is more convenient for the jeweler or engraver who needs to change or sharpen his or her tool tip often. It will also hold square tool tips most often used by jewelers and engravers in a rotated suitable position. Going back to FIG. 10, the housing intake port 52*b* has been modified over housing intake port 52*a* in FIG. 8. Housing intake port 52*b* in FIG. 10 runs through the housing walls to two additional positions on the outside of the housing. FIG. 11 is a sectional view taken along 11—11 of FIG. 10 and illustrates the two additional openings on either side of the housing 76*c* for delivery line 40 to be inserted. Isometric views in FIG. 12 and FIG. 13, further illustrate all three of the optional positions that the delivery line 40 can be inserted for the user's comfort. One of the openings to the housing intake port 52*b* is chosen by the user to insert delivery line 40 and plugs 84 and 86 illustrated in FIG. 12 are placed into the two openings that are not used.

Figure 14:
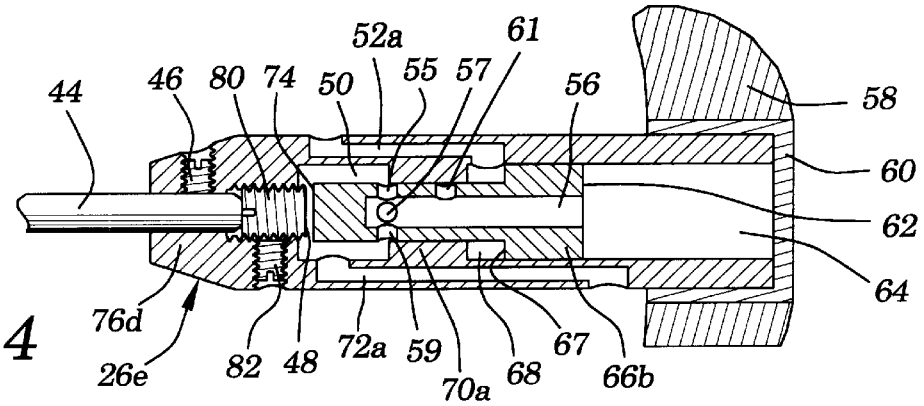
FIG. 14 illustrates a hand-held pneumatic impact tool in accordance with the present invention with a widened annular shoulder within the cylinder together with a piston that has an accommodating porting configuration.
Figure 15:
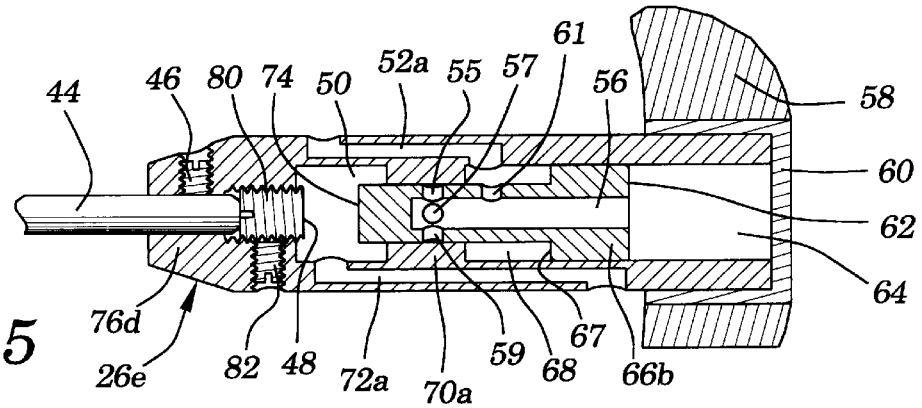
FIG. 15 is the same view as FIG. 14, differing in that the piston is occupying a rearward position.
Figure 16:
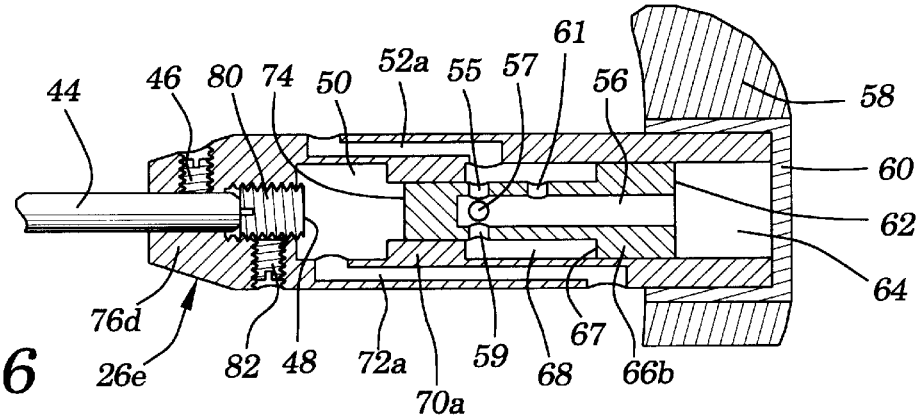
FIG. 16 is the same view as FIG. 15, differing in that the piston is occupying an extreme rearward position.

FIGS. 14–16—Sixth Embodiment

Referring to FIG. 14, FIG. 15, and FIG. 16, is illustrated a sixth embodiment. In this embodiment the annular shoulder 70*a* has been widened axially within housing 76*d*. The small step diameter of piston 66*b* has also been lengthened to accommodate the widened annular shoulder. Three piston ports 55, 57 and 59 have been included in a radial array around the small diameter of the piston so that they communicate with passage 56 within the piston. A single piston port 61 that communicates with passage 56 is included and positioned slightly rearward so that the distance from the rearward edge of piston port 61 to the front edge of piston ports 55, 57, and 59 is the same distance as the width of annular shoulder 70*a*. In this configuration, and with piston 66*b* in a forward position as illustrated in FIG. 14, the air pressure that was in rear chamber 64 that pushed the piston to this front position will be released to the atmosphere through passage 56, piston ports 55, 57 and 59, into head chamber 50, and out into the atmosphere through housing exhaust port 72*a*. Air pressure in central chamber 68 from housing intake port 52*a* will press against piston step end face 67 and begin shifting the piston in a rearward direction causing a return stroke. Referring to FIG. 15, when single piston port 61 becomes in communication with central chamber 68 the air pressure from housing intake port 52*a* and central chamber 68 will fill rear chamber 64 through passage 56. Because the surface area of rear piston face 62 is greater than the surface area of piston step end face 67, the piston will change directions and begin the impact stroke.

The design of this embodiment is such that a longer return and thus harder impacts strokes are possible. The three piston ports 55, 57 and 59 enable the rear chamber 64 to lower its air pressure quickly when piston ports 55, 57 and 59 become in communication with the head chamber 50. During the return stroke and when the single piston port 61 becomes in communication with central chamber 68 it will take rear chamber 64 longer to fill through just this single piston port 61 with sufficient pressure to change the direction of the piston therefore creating a longer return stroke. Longer return strokes are helpful in delivering harder impact strokes since the piston has more time to accelerate to a greater velocity during the impact stroke. FIG. 16 illustrates an even longer return stroke developed when much more air pressure is supplied to the handpiece. As depicted with this length of return stroke, piston ports 55, 57 and 59 will become in communication with central chamber 68 together with single piston port 61. These piston ports 55, 57 and 59 will give an additional path for sufficient air pressure to build up in rear chamber 64 thus assuring a change of direction when the returning piston does return this far into the rear chamber. It should be noted that a groove might be employed around the outside circumference of the small step of the two-step piston in such a position that it communicates with piston ports 55, 57 and 59 to help with air exhaust. In addition it should be noted, that more than three piston ports could be included together in the location of piston ports 55, 57 and 59. Three were used in FIG. 14, FIG. 15 and FIG. 16 for the simplicity of illustration.

CONCLUSION, RAMIFICATIONS, AND SCOPE

Accordingly, the reader will see that the hand-held impact tool of the invention provides superb control with a wide range of various impact adjustments for the individual needs of the engraver or jeweler. The porting configuration of the piston and housing, together with the annular shoulder provides the capability of an idling state of ultra fine piston oscillation. The piston port needs only to travel a few thousandths of an inch either way of alignment with the annular shoulder to receive sufficient air pressure to change directions. It is crucial for the engraver or jeweler user be able to place the tool tip down to the work while the tool is running in a ready-state without excessive vibration in the tool or tool tip. After the tool is in the work, the engraver or jeweler depresses the foot pedal valve, and the piston will begin taking longer strokes into the head and rear chambers until the strokes are long enough in the head chamber for the piston to begin impacting. These beginning impacts are ultra fine in energy and can be used for extremely fine hand engraving under a stereomicroscope. As the user continues to depress the foot pedal valve and further increases the air pressure, the piston will impact with increasing energy sufficient for hand engraving users who wish to engrave deeply and for jewelers who wish it for stone setting.

Furthermore, the invention has additional advantages in that:

- it provides a hand-held impact tool similar in size and shape to the traditional, comfortable, palm push engraving tool;
- it provides a hand-held impact tool with excellent control of fine impacts for use in ultra fine hand engraving;
- it provides a hand-held impact tool that has a broad range of power and that will not lose oscillation timing throughout a wide range of air pressures;
- it provides a hand-held impact tool that is not dependent on a spring for the piston's return or impact stroke;
- it provides a hand-held impact tool that will begin oscillation without requiring a surge of air pressure over the normal operating idling ready-state air pressure;
- it provides a hand-held impact tool with an idling ready-state, that can be controlled by the users' preference and needs;
- it provides a hand-held impact tool that does not vibrate excessively, allowing the user to set and position the graver into the work with confidence;
- it provides a hand-held impact tool, in which the position of the air line attachment to the impact tool can be adjusted by the operator for his or her comfort;
- it provides an adjustment within the hand-held impact tool itself for adjustment of the length and speed of the piston stroke according to the type of engraving work that is being executed; and
- it provides a hand-held impact tool in which the piston, once started oscillating in the idling ready-state with a constant fine flow of air pressure, will not stop unexpectedly between engraving cuts, but return to the fine oscillating idle when the foot pedal valve is released.

Although the invention has been described with reference to the illustrated and described embodiments, it should be noted that substitutions may be made and equivalents employed herein. For example, one or more additional housing exhaust ports 72 or 72*a* may be placed within the housing communicating with head chamber 50 and the atmosphere. In addition, an adjusting device can be used to lengthen or shorten the distance between piston port 54 and front piston face 74 that would give the equivalent result of the adjusting device described and illustrated in FIG. 7. Another example is housing 76, 76*a*, 76*b*, 76*c*, 76*d*, or a variation of the housings together with the annular shoulder 70 or 70*a* may be constructed of separate elements that are fixed or screwed together to achieve the equivalent overall construction of the housings. Still another example is any of the embodiments described or illustrated can employ a different method to hold tool tip 44 in the housings. Still another example is a groove may be employed with any of the embodiments around the outside circumference of the small step of the two-step piston in such a position that it intersects one or more than one piston port. Other examples are the features, methods, and devices employed in each of the embodiments may be mixed and matched with other features, methods or devices from the embodiments to create an equivalent, hybrid embodiment. Accordingly, the scope of the invention should be determined not by the embodiments illustrated, but by the appended claims and their legal equivalents.

I claim:

1. A hand-held pneumatic impact tool for use in delicate hand working operations for use with a supply of pressurized air, comprising:

a housing having two ends and containing a longitudinal cylindrical cavity, an annular shoulder included within said longitudinal cylindrical cavity, a two-step piston accommodated and moveable within said longitudinal cylindrical cavity, a tool tip supported at one end of said housing, said two-step piston dividing said longitudinal cylindrical cavity with said annular shoulder into:

a head chamber, defined by the end face of the smaller step of said two-step piston and facing in the direction of said tool tip, the end face of said annular shoulder and facing in the direction of said tool tip, the end of said longitudinal cylindrical cavity facing away from said tool tip;

a central chamber defined by the end face of the larger step of said two-step piston and facing in the direction of said tool tip, the end face of said annular shoulder and facing in the direction away from said tool tip;

a rear chamber defined by the end face of the larger step of said two-step piston and facing in the direction away from said tool tip, the end of said longitudinal cylindrical cavity facing towards said tool tip, a longitudinal passage provided in said two-step piston and communicating permanently with said rear chamber, at least one piston port in said two-step piston, communicating permanently with said longitudinal passage and with the side surface of the smaller step of said two-step piston, an intake port through said housing, communicating permanently with said central chamber for connection to said pressurized air source, at least one exhaust port through said housing, communicating permanently with said head chamber and with the atmosphere, said rear chamber communicating with the atmosphere when said two-step piston is so disposed relative to said housing so that said at least one piston port of said two-step piston is aligned with said head chamber communicating with the atmosphere through said at least one exhaust port, said rear chamber communicating with said pressurized air source when said two-step piston is so disposed relative to said housing so that said at least one piston port is aligned with said central chamber communicating with said pressurized air source through said intake port, an oscillation means by which said two-step piston will oscillate under the action of said supply of pressurized air, and a foot-operated air flow regulating mechanism connected between said supply of pressurized air and said housing wherein said air flow regulating mechanism, includes:

a valve for regulating air flow to said housing, and a base on which a foot pedal is mounted for pivotal movement on a horizontal axis, wherein said foot pedal is adjustable and influencing said valve in which air flow regulating ranges from zero to potential flow from said supply of pressurized air source.

2. A hand-held pneumatic impact power tool as recited in claim 1, wherein said oscillating means includes a means by which said two-step piston may oscillate without delivering impacts and oscillate with varying amounts of impact energy under the action of said supply of pressurized airs.

3. A hand-held pneumatic impact power tool as recited in claim 1, further comprising:

an additional air flow regulating mechanism, comprising:

an additional valve for controlling air flow to said housing connected between said supply of pressurized air and said housing, and an adjusting screw for adjusting air flow through said additional valve, wherein said adjusting screw will vary the air flow ranges from zero to potential flow from said supply of pressurized air.

4. A hand-held pneumatic impact power tool as recited in claim 1, further comprising:

an adjusting mechanism for adjusting the distance between the impact location of said two-step piston to said annular shoulder.

5. A hand-held pneumatic impact power tool as recited in claim 4, wherein said adjusting mechanism, includes:

an adjustable face of said longitudinal cylindrical cavity at the tool tip end of said housing.

6. A hand-held pneumatic impact power tool as recited in claim 5, wherein said adjusting face, includes a setscrew disposed between said longitudinal cylindrical cavity and said tool tip at the tool tip end of said housing.

7. A hand-held pneumatic impact power tool as recited in claim 1, wherein said intake port communicating with said central chamber, running linearly through the wall of said housing to a location on the outside surface of said housing.

8. A hand-held pneumatic impact power tool as recited in claim 1, wherein said intake port communicates from said central chamber through the wall of said housing to more than one location on the outside surface of said housing.

9. A hand-held pneumatic impact power tool as recited in claim 1, further comprising:

at least one second piston port communicating permanently with said longitudinal passage and with the side surface of the smaller step of said two-step piston, wherein said at least one second piston port disposed on said two-step piston so that when said two-step piston is in impact position said at least one second piston port is closed off from said central chamber and closed off from said head chamber by said annular shoulder and at the same time said at least one piston port is in communication with said head chamber.

10. A hand-held pneumatic impact power tool as recited in claim 1, further comprising:

a groove around the circumference of the smaller step of said two-step piston disposed in communication with said at least one piston port.

11. A hand-held pneumatic impact power tool as recited in claim 1, further comprising:

a handle that is shaped to comfortably fit the palm of the hand of a human disposed and supported on the end of said housing.

12. A hand-held pneumatic impact tool for use in delicate hand working operations for use with a supply of pressurized air, comprising:

a body having a tool supporting end and a handle supporting end, a bore within said body having a first end in the direction of said tool supporting end and a second end in the direction of said handle supporting end, an annular ring disposed within said bore, a stepped piston disposed within said bore movable longitudinally within said bore, a head chamber defined within said bore between one edge face of said annular ring in the direction toward said first end and said first end, a central chamber defined within said bore between one edge face of said annular ring in the direction toward said second end and the step face on said stepped piston in the direction of said first end, a rear chamber defined within said bore between the end of said stepped piston in the direction as said second end and said second end, a longitudinal passage within said stepped piston and communicating permanently with said rear chamber, at least one piston port in said stepped piston, communicating permanently with said longitudinal passage and with the side surface of the smaller step of said stepped piston, an intake port through said body, communicating permanently with said central chamber for connection to said pressurized air source, at least one exhaust port through said body, communicating permanently with said head chamber and with the atmosphere, said rear chamber communicating with the atmosphere when said stepped piston is disposed relative to said body so that said at least one piston port of said stepped piston is in communication with said head chamber and with the atmosphere through said at least one exhaust port, said rear chamber communicating with said pressurized air source when said stepped piston is disposed relative to said housing so that said at least one piston port is in communication with said central chamber and with said pressurized air source through said intake port, and an oscillation means by which said stepped piston may oscillate without delivering impacts and oscillate with varying amounts of impact energy under the action of said supply of pressurized air.

13. A hand-held pneumatic impact power tool as recited in claim 12, further comprising:

a foot-operated air flow regulating mechanism connected between said supply of pressurized air and said body, wherein said air flow regulating mechanism, includes:

a valve for regulating air flow to said body, and a base on which a foot pedal is mounted for pivotal movement on a horizontal axis, wherein said foot pedal is adjustable and influencing said valve in which air flow regulating ranges from zero to potential flow from said supply of pressurized air source.

14. A hand-held pneumatic impact power tool as recited in claim 13, wherein said intake port communicating with said central chamber, running linearly through the wall of said body to a location on the outside surface of said body.

15. A hand-held pneumatic impact power tool as recited in claim 13, wherein said intake port communicates from said central chamber, through the wall of said body to more than one location on the outside surface of said body.

16. A hand-held pneumatic impact power tool as recited in claim 13, further comprising:

at least one second piston port communicating permanently with said longitudinal passage and with the side surface of the smaller step of said stepped piston, wherein said at least one second piston port disposed on said stepped piston so that when said stepped piston is in impact position said at least one second piston port is closed off from said central chamber and closed off from said head chamber by said annular ring and at the same time said at least one piston port is in communication with said head chamber.

17. A hand-held pneumatic impact power tool as recited in claim 13, further comprising:

a groove around the circumference of the smaller step of said stepped piston is disposed in communication with said at least one piston port.

18. A hand-held pneumatic impact power tool as recited in claim 13, further comprising:

a handle shaped to comfortably fit the palm of the hand of a human disposed and supported on said handle supporting end.

19. A hand-held pneumatic impact power tool as recited in claim 12, further comprising:

an additional air flow regulating mechanism, comprising:

an additional valve for controlling air flow to said body connected between said supply of pressurized air and said body, and an adjusting screw for adjusting air flow through said additional valve, wherein said adjusting screw will vary the air flow ranges from zero to potential flow from said supply of pressurized air.

20. A hand-held pneumatic impact power tool as recited in claim 12, further comprising:

an adjusting mechanism for adjusting the distance between the impact location of said stepped piston to said annular ring.

21. A hand-held pneumatic impact power tool as recited in clam 20, wherein said adjusting mechanism, includes:

an adjustable face of said first end for adjusting the length of said bore within said body.

22. A hand-held pneumatic impact power tool as recited in clam 21, wherein said adjusting face, includes:

a setscrew disposed between said tool supporting end and said first end of said bore.

* * * * *

UNITED STATES PATENT AND TRADEMARK OFFICE

CERTIFICATE OF CORRECTION

PATENT NO. : 6,095,256
DATED : September 22, 2000
INVENTOR(S) : Steven James Lindsay It is certified that error appears in the above-identified patent and that said Letters Patent is hereby corrected as shown below:

Columns 11 and 12,

All of claim number 1 is displayed below with corrections made showing the correct formatting
page indention for the claim.

1. A hand-held pneumatic impact tool for use in delicate hand working operations for use with a supply of pressurized air, comprising:
a housing having two ends and containing a longitudinal cylindrical cavity,
an annular shoulder included within said said longitudinal cylindrical cavity,
a two-step piston accommodated and longitudinal cylindrical cavity,
a tool tip supported at one end of said housing,
said two-step piston dividing said longitudinal cylindrical cavity with said annular shoulder into:
a head chamber, defined by the end face of the smaller step of said two-step piston and facing in the direction of said tool tip, the end face of said annular shoulder and facing in the direction of said longitudinal cylindrical cavity facing away from said tool tip;a central chamber defined by the end face of the larger step of said two-step piston and facing in the direction said tool tip, the end face of said annular shoulder and facing in the direction away from said tool tip; a rear chamber defined by the end face of the larger step of said two-step piston and facing in the direction away from said tool tip, the end of said longitudinal cylindrical cavity facing towards said tool tip, a longitudinal passage provided in said two-step piston and communicating permanently with said rear chamber, at least one piston port in said two-step piston, communicating permanently with said longitudinal passage and with the side surface of the smaller step of said two-step piston an intake port through said housing, communicating permanently with said central chamber for connection to said pressurized air source, at least one exhaust port through said housing, communicating permanently with said head chamber and with the atmosphere, said rear chamber communicating with the atmosphere when said two-step piston is so disposed relative to sad housing so that said at least one piston port of said two-step piston is aligned with said head chamber communicating with the atmosphere through said at least one exhaust port,

UNITED STATES PATENT AND TRADEMARK OFFICE

CERTIFICATE OF CORRECTION

PATENT NO. : 6,095,256
DATED : September 22, 2000
INVENTOR(S) : Steven James Lindsay It is certified that error appears in the above-identified patent and that said Letters Patent is hereby corrected as shown below:

said rear chamber communicating with said pressurized air source when said source when said two-step piston is so disposed relative to said housing so that said at least one piston port is aligned with said central chamber communicating with said pressurized air source through said intake port, an oscillation means by which said two-step piston will oscillate under the action of said supply of pressurized air, and a foot-operated air flow regulating mechanism connected between said supply of pressurized air and said housing wherein said air flow regulating mechanism, includes:

a valve for regulating air flow to said housing, and a base on which a foot pedal is mounted for pivotal movement on a horizontal axis wherein said foot pedal is adjustable and influencing said valve in which air flow regulating ranges from zero to potential flow from said supply of pressurized air source.

Signed and Sealed this

Twenty-ninth Day of January, 2002

*Attest:*

*Attesting Officer*

JAMES E. ROGAN
*Director of the United States Patent and Trademark Office*